US009070340B2

(12) United States Patent
Hasegawa et al.

(10) Patent No.: US 9,070,340 B2
(45) Date of Patent: Jun. 30, 2015

(54) DRIVING DEVICE OF DISPLAY DEVICE

(75) Inventors: Hideaki Hasegawa, Ibaraki (JP); Hiroyoshi Ichikura, Ibaraki (JP); Kazuhide Aoyama, Ibaraki (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 923 days.

(21) Appl. No.: 13/249,626

(22) Filed: Sep. 30, 2011

(65) Prior Publication Data

US 2012/0086697 A1 Apr. 12, 2012

(30) Foreign Application Priority Data

Oct. 12, 2010 (JP) ..... 2010-229374

(51) Int. Cl.
*G09G 3/36* (2006.01)

(52) U.S. Cl.
CPC ..... *G09G 3/3688* (2013.01); *G09G 3/3696* (2013.01); *G09G 2310/0275* (2013.01); *G09G 2330/021* (2013.01)

(58) Field of Classification Search
CPC ..... G09G 3/3688; G09G 3/3696; G09G 2310/0275; G09G 2330/021
USPC ..... 345/76–104, 204–214, 690–699
See application file for complete search history.

(56) References Cited

U.S. PATENT DOCUMENTS

| | | | | |
|---|---|---|---|---|
| 7,847,797 | B2 | 12/2010 | Yamazaki | |
| 8,130,217 | B2 * | 3/2012 | Nishimizu et al. | 345/211 |
| 2008/0238497 | A1 * | 10/2008 | Yamazaki et al. | 327/111 |
| 2009/0073152 | A1 * | 3/2009 | Yamazaki | 345/211 |
| 2009/0121751 | A1 * | 5/2009 | Bach | 327/108 |
| 2009/0174372 | A1 | 7/2009 | Maeda et al. | |
| 2010/0123704 | A1 * | 5/2010 | Nishimizu et al. | 345/211 |

FOREIGN PATENT DOCUMENTS

| | | | |
|---|---|---|---|
| JP | 2001-166741 | | 6/2001 |
| JP | 2008046358 | A | 2/2008 |
| JP | 2009-139538 | | 6/2009 |
| WO | 2007135789 | A1 | 11/2007 |

OTHER PUBLICATIONS

Japanese Office Action dated May 7, 2014.

* cited by examiner

*Primary Examiner* — Dmitriy Bolotin
(74) *Attorney, Agent, or Firm* — Volentine & Whitt, PLLC

(57) ABSTRACT

There is provided a driving device of a display device, including: a first switching portion; a second switching portion; and a control section that, when the potential of a drive signal line is lower than a target potential, operates the first switching portion by using, as a first reference potential, a potential that is less than or equal to the target potential and that is closest to the target potential, among predetermined n types (n≥1) of potentials, and, when the potential of the drive signal line is higher than the target potential, operates the second switching portion by using, as a second reference potential, a potential that is greater than or equal to the target potential and that is closest to the target potential, among the n types of potentials.

10 Claims, 8 Drawing Sheets

DRIVING DEVICE OF DISPLAY DEVICE

CROSS-REFERENCE TO RELATED APPLICATION

This application is based on and claims priority under 35 USC 119 from Japanese Patent Application No. 2010-229374 filed on Oct. 12, 2010, the disclosure of which is incorporated by reference herein.

BACKGROUND

1. Technical Field

The present invention relates to a driving device of a display device, and in particular, relates to a driving device of a display device that supplies voltage, that corresponds to display data, to a display device and drives the display device.

2. Related Art

A driving device, that is equipped with a source driver that drives data lines and a gate driver that drives gate lines, is connected to an active-matrix-type display device (e.g., a TFT (Thin Film Transistor)-LCD (Liquid Crystal Display), or the like) in which the plural data lines are provided along the X direction, the plural gate lines are provided along the Y direction, and display cells (pixels) are respectively provided at the positions of intersection between the individual data lines and the individual gate lines. Display data of one line, which is formed from pixels corresponding to a same gate line, is inputted to this type of display device in order from a data source such as a graphic processor or the like, at each cycle of a horizontal synchronizing signal.

At each cycle of the horizontal synchronizing signal, the source driver of the driving device transfers display data of one line, that has been successively inputted from the data source, to a shift register and holds the data in latches, and, by level shifters, decoder circuits and amplification circuits, generates data voltages corresponding to the display data of one line that was inputted in the previous cycle, and supplies the generated data voltages to the individual data lines and writes the data voltages to the respective pixels of one line. Further, the gate driver of the driving device supplies a gate signal to a single gate line, and, at each cycle of the horizontal synchronizing signal, switches the gate line to which the gate signal is supplied. Due thereto, the driving device is driven, and an image expressed by the display data is displayed on the display device.

In relation to the above, Japanese Patent Application Laid-Open (JP-A) No. 2001-166741 discloses a structure in which pre-charging circuits, that generate voltages, at which the levels of the gradation voltages corresponding to the display data are shifted, and supplies the generated voltages to the drain signal lines during a pre-charging period, are provided between decoder circuits and output amplification circuits of a drain driver.

Further, JP-A No. 2009-139538 discloses a technique of providing a second decoder, that selects pre-charge voltages corresponding to image data from plural pre-charge voltages and outputs the selected pre-charge voltages, and supplying, to data lines, the pre-charge voltages outputted from the second decoder.

As the operating speeds of display devices are made to be faster, an increase in operating speed is demanded as well of driving devices that drive display devices. At the source driver of the above-described driving device, conventionally, as shown as an example in FIG. 6A, the operating speed of the amplification circuit, that is structured by an operational amplifier or the like, is the lowest among the respective structural elements of the source driver, and delays in the output of the amplification circuit are the main cause of impeding improvement in the operating speed of the source driver. To address this problem, the delay in the output of the amplification circuit has been greatly reduced, as shown by "output of single amplification circuit after speed increased" in FIG. 6B as an example, by technological improvements at the periphery of the amplification circuit in recent years. However, accompanying this, the delay in the output of the decoder circuit, which is positioned at the stage before the amplification circuit, has become the main cause of impeding improvement in the operating speed of the source driver, instead of the delay in output of the amplification circuit. Because the output of the amplification circuit depends on the output of the decoder circuit, the operating speed of the source driver has not been sufficiently improved relative to the extent that the delay in the output of the amplification circuit has been greatly reduced.

To address this, the technique disclosed in JP-A No. 2001-166741 varies the potential of the drain signal line (the data line) at the output side of the decoder circuit by the pre-charge circuit, and is therefore thought to be effective in improving the operating speed of the source driver. However, in the technique disclosed in JP-A No. 2001-166741, the supply of voltage to the data line continues during the time until the pre-charging period ends, regardless of whether or not the potential of the data line (the drain signal line) has reached the pre-charge potential (PC potential). Therefore, as is clear also from FIG. 11 of JP-A No. 2001-166741, there is the problem that, for the near-end pixels that are near to the source driver in particular, voltage is supplied to the data line for a relatively long time period even after the potential of the data line reaches the PC potential, and electric power is consumed wastefully. Further, in the technique of JP-A No. 2001-166741, as shown also in FIG. 11 of JP-A No. 2001-166741, the potential of the data line is temporarily raised to the PC potential that is higher than the final potential, and thereafter, is lowered to the final potential, and this temporary raising of the potential of the data line to the PC potential also is related to an increase in the electric power that is wastefully consumed.

Further, with regard to the technique disclosed in JP-A No. 2009-139538 as well, the supply of pre-charge voltage to the data line continues during the time until the pre-charging period ends, regardless of whether the potential of the data line has reached the pre-charge potential, as is clear also from FIG. 3 and FIG. 6 of JP-A No. 2009-139538. Therefore, in the same way as the technique of JP-A No. 2001-166741, there is the problem that electric power is consumed wastefully.

SUMMARY

The present invention was made in consideration of the above-described circumstances, and an object thereof is to provide a driving device of a display device that can realize increased operating speed while suppressing wasteful consumption of electric power.

In order to achieve the above-described object, an aspect of the present invention provides a driving device of a display device, including:

a first switching portion that is provided between a potential switching portion, that switches a potential of a drive signal line to a target potential that corresponds to display data, and a display device, to which the potential of the drive signal line is supplied as voltage, the first switching portion connecting the drive signal line to a power source during a time until the potential of the drive signal line reaches a first reference potential that is higher than that potential;

a second switching portion that is provided between the potential switching portion and the display device, and that connects the drive signal line to a ground line during a time until the potential of the drive signal line reaches a second reference potential that is lower than that potential; and a control section that, when the potential of the drive signal line is lower than the target potential, operates the first switching portion by using, as the first reference potential, a potential that is less than or equal to the target potential and that is closest to the target potential, among predetermined n types ($n \geq 1$) of potentials, and, when the potential of the drive signal line is higher than the target potential, operates the second switching portion by using, as the second reference potential, a potential that is greater than or equal to the target potential and that is closest to the target potential, among the n types of potentials.

In the first aspect of the present invention, the first switching portion, that connects the drive signal line to a power source during the time until the potential of the drive signal line reaches the first reference potential that is higher than that potential, and the second switching portion, that connects the drive signal line to a ground line during the time until the potential of the drive signal line reaches the second reference potential that is lower than that potential, are respectively provided between the potential switching portion, that switches the potential of the drive signal line to the target potential that corresponds to display data, and the display device, to which the potential of the drive signal line is supplied as voltage. Further, when the potential of the drive signal line is lower than the target potential, the control section operates the first switching portion by using, as the first reference potential, a potential that is less than or equal to the target potential and that is closest to the target potential, among predetermined n types (n 1) of potentials. When the potential of the drive signal line is higher than the target potential, the control section operates the second switching portion by using, as the second reference potential, a potential that is greater than or equal to the target potential and that is closest to the target potential, among the n types of potentials.

In this way, in the first aspect of the present invention, when the potential of the drive signal line is lower than the target potential, the time until the potential of the drive signal line reaches the target potential is shortened due to the drive signal line being connected to the power source by the first switching portion during the time until the potential of the drive signal line reaches the first reference potential, that is the potential that is less than or equal to the target potential and is the closest to the target potential, among the n types of potentials. Further, when the potential of the drive signal line is higher than the target potential, the time until the potential of the drive signal line reaches the target potential is shortened due to the drive signal line being connected to the ground line by the second switching portion, during the time until the potential of the drive signal line falls to the second reference potential, that is the potential that is greater than or equal to the target potential and is the closest to the target potential, among the n types of potentials. Due thereto, increased operating speed of the driving device of a display device relating to the present invention can be realized.

Further, the first switching portion is structured to connect the drive signal line to the power source during the time until the potential of the drive signal line reaches the first reference potential, and the connection between the drive signal line and the power source is cut-off when the potential of the drive signal line reaches the first reference potential. Further, the second switching portion also is a structure that connects the drive signal line to the ground line during the time until the potential of the drive signal line reaches the second reference potential, and the connection between the drive signal line and the ground line is cut-off when the potential of the drive signal line reaches the second reference potential. Accordingly, wasteful consumption of electric power can be suppressed as compared with a structure in which voltage is supplied to the drive signal line for a given time period regardless of whether or not the potential of the drive signal line has reached a given potential.

Note that plural first switching portions may be provided, and potentials, that are different from one another among the n types of potentials, may be supplied as the first reference potential to the individual first switching portions (second aspect). In this structure, when the potential of the drive signal line is lower than the target potential, operating the first switching portion by using, as the first reference potential, a potential that is less than or equal to the target potential and closest to the target potential among the n types of potentials, can be realized by, more specifically and for example, structuring the control section to, when the potential of the drive signal line is lower than the target potential, operate, among the plural first switching portions, the first switching portion to which a potential, that is less than or equal to the target potential and that is closest to the target potential, is supplied as the first reference potential.

Further, when third switching portions are respectively provided between the individual first switching portions and the power source, operating, among the plural first switching portions, the first switching portion to which a potential, that is less than or equal to the target potential and is closest to the target potential, is supplied as the first reference potential can be realized by, more specifically and for example, structuring the control section to operate a specific first switching portion by turning on, of the plural third switching portions, the third switching portion that is provided between the power source and the specific first switching portion that is to be operated (third aspect).

Further, any of the first through third aspects may be structured such that plural second switching portions are provided, and potentials, that are different from one another among the n types of potentials, are supplied as the second reference potential to the individual second switching portions (fourth aspect). In this structure, when the potential of the drive signal line is higher than the target potential, operating the second switching portion by using, as the second reference potential, a potential that is greater than or equal to the target potential and closest to the target potential among the n types of potentials, can be realized by, more specifically and for example, structuring the control section to, when the potential of the drive signal line is higher than the target potential, operate, among the plural second switching portions, the second switching portion to which a potential, that is greater than or equal to the target potential and that is closest to the target potential, is supplied as the second reference potential.

Further, in a fourth aspect, when fourth switching portions are respectively provided between the individual second switching portions and the ground line, operating, among the plural second switching portions, the second switching portion to which a potential, that is greater than or equal to the target potential and is closest to the target potential, is supplied as the second reference potential can be realized by, more specifically and for example, structuring the control section to operate a specific second switching portion by turning on, of the plural fourth switching portions, the fourth switching portion that is provided between the ground line and the specific second switching portion that is to be operated (fifth aspect).

Further, any of the first, fourth and fifth aspects may be structured such that any one potential among the n types of potentials is selectively supplied to the first switching portion as the first reference potential (sixth aspect). In this structure, when the potential of the drive signal line is lower than the target potential, operating the first switching portion by using, as the first reference potential, a potential that is less than or equal to the target potential and is closest to the target potential among the n types of potentials, can be realized by, more specifically and for example, structuring the control section to, when the potential of the drive signal line is lower than the target potential, cause a potential, that is less than or equal to the target potential and that is closest to the target potential among the n types of potentials, to be supplied to the first switching portion as the first reference potential.

Moreover, any of the first, fourth and fifth aspects may be structured such that any one potential among the n types of potentials is selectively supplied to the second switching portion as the second reference potential (seventh aspect). In this structure, when the potential of the drive signal line is higher than the target potential, operating the second switching portion by using, as the second reference potential, a potential that is greater than or equal to the target potential and is closest to the target potential among the n types of potentials, can be realized by, more specifically and for example, structuring the control section to, when the potential of the drive signal line is higher than the target potential, cause a potential, that is greater than or equal to the target potential and that is closest to the target potential among the n types of potentials, to be supplied to the second switching portion as the second reference potential.

Any of the first through seventh aspects can be structured such that the first switching portion includes an NMOS transistor whose back gate is connected to the ground line, and the second switching portion includes a PMOS transistor whose back gate is connected to the power source (eighth aspect).

Further, any of the first through seventh aspects can be structured such that the first switching portion includes an NMOS transistor whose back gate is connected to the drive signal line, and the second switching portion includes a PMOS transistor whose back gate is connected to the drive signal line (ninth aspect). The back gate of the NMOS transistor is usually connected to the ground line, and the back gate of the PMOS transistor is usually connected to the power source, as in the previous eighth aspect. Therefore, when the back gates of the NMOS transistor of the first switching portion and the PMOS transistor of the second switching portion are connected to the drive signal line as described above, these transistors must be separated from other transistors, and the circuit surface area increases.

However, when the back gate of the NMOS transistor is connected to the ground line and the back gate of the PMOS transistor is connected to the power source, a potential difference arises (back bias is applied) between the back gates and the drive signal line, and there is the possibility that the transistor will turn off at a time that is slightly earlier than the time when the potential of the drive signal line reaches the reference potential. In contrast, when the back gates are connected to the drive signal line as described above, back bias is not applied. Therefore, the above respective transistors can be made to be on until the time when the potential of the drive signal line reaches the first reference potential or the second reference potential, and the state in which the drive signal line is connected to the power source or the ground line can be continued until the time when the potential of the drive signal line reaches the first reference potential or the second reference potential.

Further, the eight or ninth aspect may be structured such that a potential, that is higher than the first reference potential by a predetermined value, is supplied to the gate of the NMOS transistor of the first switching portion, and a potential, that is higher than the second reference potential by a predetermined value, is supplied to the gate of the PMOS transistor of the second switching portion (tenth aspect). In this case as well, in the same way as in the ninth aspect, the above respective transistors can be made to be on until the time when the potential of the drive signal line reaches the first reference potential or the second reference potential, and the state in which the drive signal line is connected to the power source or the ground line can be continued until the time when the potential of the drive signal line reaches the first reference potential or the second reference potential.

Any of the first through tenth aspects can be structured such that, when an amplification circuit is further provided between the potential switching portion and the display device, the first switching portion and the second switching portion connect a region of the drive signal line, which region is between the potential switching portion and the amplification circuit, to the power source or the ground line (eleventh aspect).

As described above, the present invention is provided with the first switching portion, that connects the drive signal line to a power source during the time until the potential of the drive signal line reaches the first reference potential that is higher, and the second switching portion, that connects the drive signal line to a ground line during the time until the potential of the drive signal line reaches the second reference potential that is lower, between the potential switching portion, that switches the potential of the drive signal line to a target potential that corresponds to display data, and the display device, to which the potential of the drive signal line is supplied as voltage. When the potential of the drive signal line is lower than the target potential, the first switching portion is operated by using, as the first reference potential, a potential that is less than or equal to the target potential and that is closest to the target potential, among n types of potentials. When the potential of the drive signal line is higher than the target potential, the second switching portion is operated by using, as the second reference potential, a potential that is greater than or equal to the target potential and that is closest to the target potential, among the n types of potentials. Therefore, the present invention has the excellent effect of being able to realize increased operating speed while suppressing wasteful consumption of electric power.

BRIEF DESCRIPTION OF THE DRAWINGS

Exemplary embodiments of the present invention will be described in detail based on the following figures, wherein.

DETAILED DESCRIPTION

Examples of exemplary embodiments of the present invention are described hereinafter with reference to the drawings.

First Exemplary Embodiment

Figure 1:
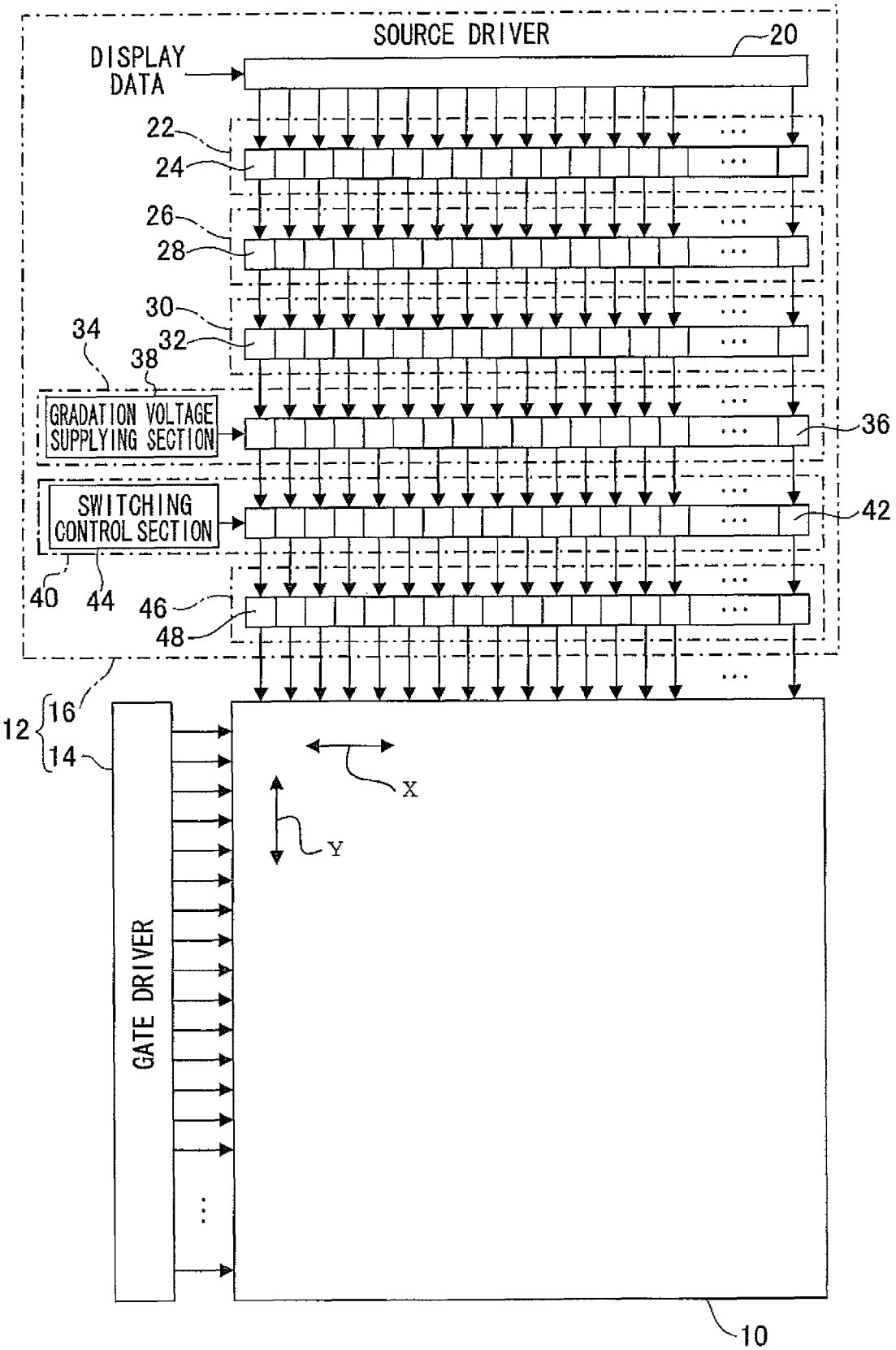
FIG. 1 is a block diagram showing the schematic structure of a driving device of a display device that is described in the exemplary embodiments, together with a display device.

A display device 10, and a driving device 12 having a gate driver 14 and a source driver 16 that are connected to the display device 10, are shown in FIG. 1. Note that the driving device 12 is an example of the driving device of a display device relating to the present invention.

The display device 10 may be any of various types of known display devices, provided that it is an active-matrix-type display device. For example, when the display device 10 is a TFT-LCD, the display device 10 is structured as follows, although not illustrated: liquid crystals are sealed between a pair of transparent substrates that are disposed so as to face one another at a predetermined interval, and electrodes are formed on the entire facing surface of one of the transparent substrates, and numerous data lines, that are disposed at uniform intervals along the X direction in FIG. 1 and extend along the Y direction in FIG. 1, and numerous gate lines, that are disposed at uniform intervals along the Y direction in FIG. 2 and extend along the X direction in FIG. 1, are respectively provided on the facing surface of the other transparent substrate, and thin film transistors (TFTs) and electrodes are disposed respectively at the intersecting positions of the individual data lines and the individual gate lines (the pixel positions). At each of the TFTs, the source is connected to the electrode, the gate is connected to the gate line, and the drain is connected to the data line. Hereinafter, explanation is given by using, as an example, a case in which the display device 10 is a TFT-LCD.

The driving device 12 has the gate driver 14 and the source driver 16. The individual gate lines of the display device 10 are respectively connected to the gate driver 14, and the individual data lines of the display device 10 are respectively connected to the source driver 16. The gate driver 14 is connected to a timing controller (not illustrated). In accordance with gate driver control signals that are inputted from the timing controller, the gate driver 14 repeats supplying a gate signal for a predetermined time to one of the gate lines among the numerous gate lines of the display device 10, and turning the TFTs of the pixels of the one line connected to that gate line on for a predetermined time, while switching, in order and at a timing that is synchronized with the horizontal synchronizing signal, the gate line to which the gate signal is supplied.

On the other hand, the source driver 16 is structured by a shift driver 20, a first latch circuit group 22 that has a same number of latch circuits 24 as the number of pixels of one line, a second latch circuit group 26 that has a same number of latch circuits 28 as the number of pixels of one line, a level shifter group 30 having a same number of level shifters 32 as the number of pixels of one line, a decoder circuit group 34 having a same number of decoder circuits 36 as the number of pixels of one line, a potential changing assisting circuit group 40 having a same number of potential changing assisting circuits 42 as the number of pixels of one line, and an amplification circuit group 46 having a same number of amplification circuits 48 as the number of pixels of one line, being connected in order.

Display data of one line, that is formed from pixels corresponding to a same gate line of the display device 10, are inputted to the source driver 16 in order in units of one pixel from a data source such as a graphic processor or the like, at each cycle of the horizontal synchronizing signal in this type of driving device. The shift register 20 transfers, in order, the display data of one line that was inputted in order in units of one pixel, and thereafter, outputs the display data to the first latch circuit group 22. Due thereto, display data of one pixel, among the display data of one line and that differ from one another, is held in each of the individual latch circuits 24 of the first latch circuit group 22.

The second latch circuit group 26 is for signal processings, by the circuits from the level shifter group 30 on, to be carried out on the display data that is held in the second latch circuit group 26, in parallel to the transfer of display data by the shift register 20 and the holding of display data in the first latch circuit group 22. The respective display data of one pixel that are held in the individual latch circuits 24 of the first latch circuit group 22 are temporarily transferred to and held in the individual latch circuits 28 of the second latch circuit group 26, and thereafter, are outputted to the individual level shifters 32 of the level shifter group 30.

The individual level shifters 32 of the level shifter group 30 convert the voltage levels of the display data, that are inputted from the latch circuits 28 of the second latch circuit group 26, into higher voltage levels that are suited to the operation of the decoder circuits 36 and the like of the latter stages, and output the display data, after level conversion, to the individual decoder circuits 36 of the decoder circuit group 34.

A gradation voltage generating section 38, that generates plural types of gradation voltages whose voltage levels differ from one another, is provided at the decoder circuit group 34. The plural types of gradation voltages generated by the gradation voltage generating section 38 are respectively supplied to the individual decoder circuits 36. Each of the decoder circuits 36 selects, from among the plural types of gradation voltages supplied from the gradation voltage generating section 38, the gradation voltage that corresponds to the display data of one pixel that was inputted thereto from the level shifter 32 that is the previous stage, and changes the voltage level (potential) of the output signal line to the selected gradation voltage, and thereby outputs the selected gradation voltage to the circuit that is the following stage. Note that the individual potential changing assisting circuits 42 of the potential changing assisting circuit group 40 are described later.

Although not illustrated, each of the amplification circuits 48 of the amplification circuit group 46 has an operational amplifier to whose input end is connected the output signal line of the decoder circuit 36. A peripheral circuit is connected to the operational amplifier so that the operational amplifier functions as a voltage follower, and the output end of the operational amplifier is connected to the data line. Due thereto, the current of the voltage (data voltage) of the output signal line is amplified and supplied to the data line by (the operational amplifier of) the amplification circuit 48 without the voltage level thereof being changed.

Due thereto, the data voltages that are supplied to the data lines from the individual amplification circuits 48 of the amplification circuit group 46 are respectively applied to the pixels of the one line that corresponds to the gate line to which the gate signal is being supplied by the gate driver 14, among the respective lines of the display device 10, and the light transmission rates of the liquid crystals at the positions of the respective pixels to which the data voltages are applied change in accordance with the magnitudes of the applied data voltages. An image of one line is thereby displayed on the display device 10. Then, by switching in order the gate line to which the gate signal is supplied by the gate driver 14, and switching in order the line of the source driver 16 to which the display data is inputted, the image is displayed on the display device 10.

Figure 2:
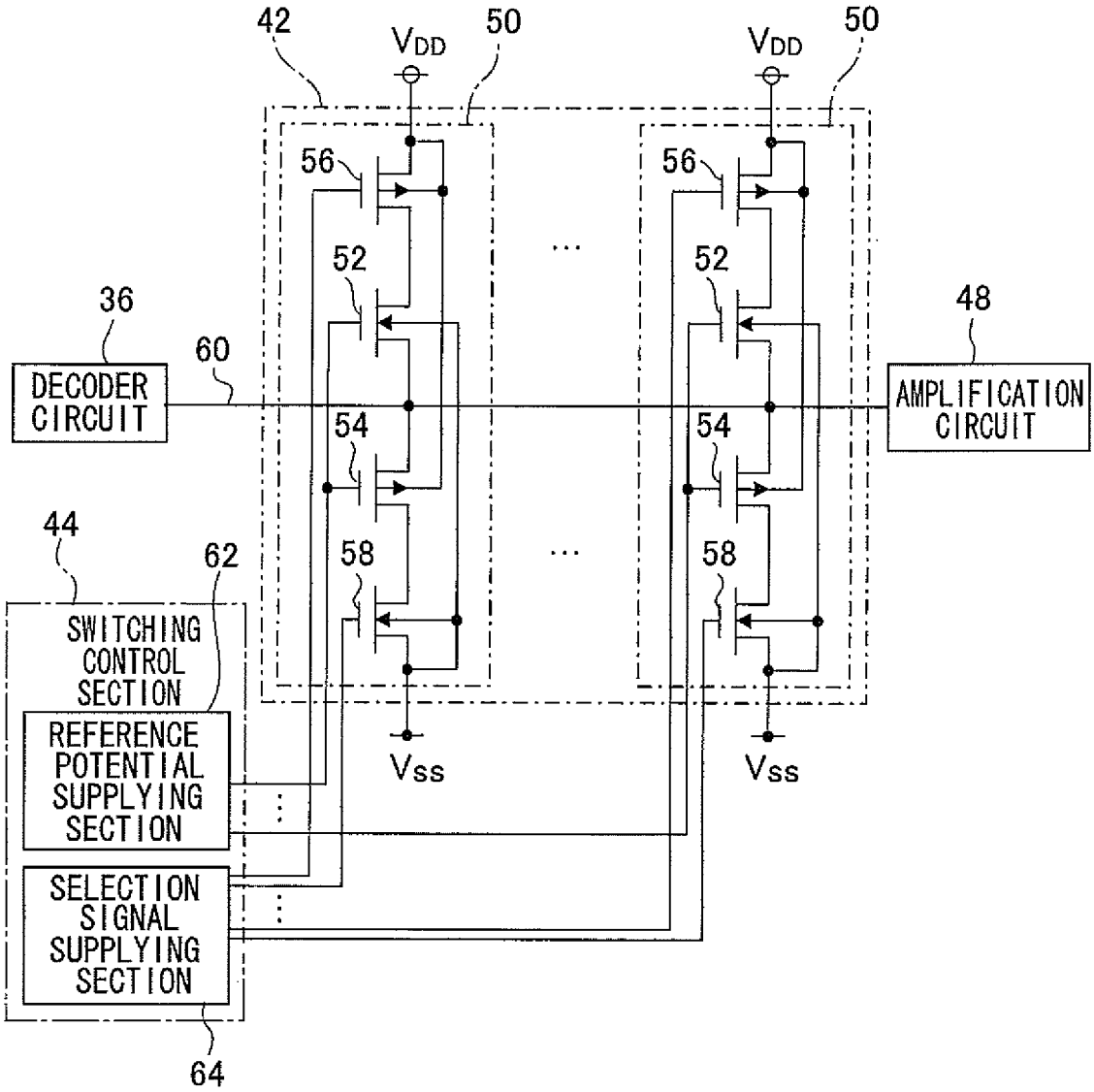
FIG. 2 is a circuit diagram showing the structure of a potential changing assisting circuit relating to a first exemplary embodiment.

The potential changing assisting circuits 42, that are provided at the potential changing assisting circuit group 40 in the same number as the number of pixels of one line, are described next with reference to FIG. 2. A single one of the potential changing assisting circuits 42 that corresponds to a single pixel (data line) is shown in FIG. 2. Provided at the potential changing assisting circuit 42 are n (e.g., n>1) potential detecting/changing circuits 50. A switching control section 44, which has a reference potential supplying section 62 and a selection signal supplying section 64, also is provided at the potential changing assisting circuit group 40.

Each of the potential detecting/changing circuits 50 has an NMOS transistor 52 and a PMOS transistor 54 for detection, and a PMOS transistor 56 and an NMOS transistor 58 for selection. The drain of the NMOS transistor 52 for detection is connected to an output signal line 60, the source is connected to the source of the PMOS transistor 56 for selection, the gate is connected to the reference potential supplying section 62, and the back gate (also called the substrate gate) is connected to a ground line and maintained at potential VSS. Further, the drain of the PMOS transistor 54 for detection is connected to the output signal line 60, the source is connected to the source of the NMOS transistor 58 for selection, the gate is connected to the reference potential supplying section 62, and the back gate is connected to the power source and maintained at potential VDD.

The drain and the back gate of the PMOS transistor 56 for selection are connected to the power source and maintained at the potential VDD, and the gate is connected to the selection signal supplying section 64. Further, the drain and the back gate of the NMOS transistor 58 for selection are connected to the ground line and maintained at the potential VSS, and the gate is connected to the selection signal supplying section 64. Note that the number n of the potential detecting/changing circuits 50 that are provided at the single potential changing assisting circuit 42 can be set in accordance with, for example, conditions such as the circuit scale that is permitted for the driving device 12, the extent of increasing the operating speed with respect to the driving device 12, or the like.

Further, the reference potential supplying section 62 of the switching control section 44 supplies, as reference potentials Vref, voltages (potentials) of voltage levels that are within a range from a minimum value to a maximum value of data voltages outputted from the decoder circuit 36 and that respectively differ for each of the potential detecting/changing circuits 50 among the n types of voltage levels, to the gates of the NMOS transistor 52 and PMOS transistor 54 for detection of the individual potential detecting/changing circuits 50.

Figure 3A:
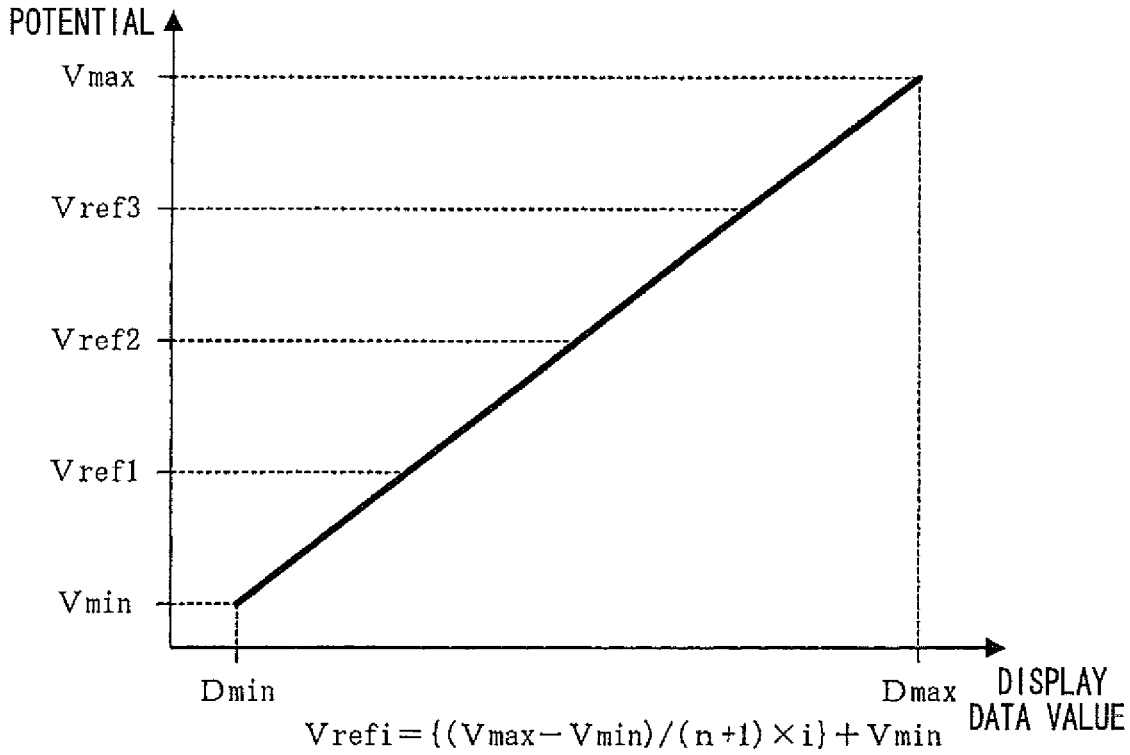
FIG. 3A is a graph showing an example of reference potentials that are supplied respectively to the n potential changing assisting circuits.

As an example, FIG. 3A shows examples of, when the number n of the potential detecting/changing circuits 50 is n=3, reference potentials Vref1 through Vref3 that are supplied to the gates of the NMOS transistor 52 and PMOS transistor 54 for detection of the individual potential detecting/changing circuits 50. In FIG. 3A, potential Vmin is the data voltage that is outputted from the decoder circuit 36 when a minimum value Dmin of the display data is inputted, and potential Vmax is the data voltage that is outputted from the decoder circuit 36 when a maximum value Dmax of the display data is inputted. The reference potential supplying section 62 is structured so as to, as shown in FIG. 3A for example, supply, as the reference potential Vref and to the NMOS transistor 52 and PMOS transistor 54 for detection of the individual potential detecting/changing circuits 50, potentials that correspond to the borders at respective ranges when a range (Vmin to Vmax), of the data voltage outputted from the decoder circuit 36, is divided uniformly into plural ranges of a number (=n+1=4) that corresponds to the number n of the potential detecting/changing circuits 50.

Further, the display data after level conversion that is inputted to the decoder circuit 36 is inputted to the selection signal supplying section 64 of the potential detecting/changing circuits 50. (Instead of this, the display data before level conversion may be inputted.) On the basis of the inputted display data, the selection signal supplying section 64 recognizes a target potential in the changing of the potential of the output signal line 60 by the decoder circuit 36, before the potential of the output signal line 60 is changed by the decoder circuit 36. Further, the selection signal supplying section 64 holds the target potential of the output signal line 60, that was recognized in the one cycle before (the previous cycle) of the horizontal synchronizing signal, and, by comparing the recognized target potential with the target potential of the previous cycle, judges whether the direction of change in the potential of the output signal line 60 by the decoder circuit 36 in the current cycle is raising or lowering of the potential.

When the selection signal supplying section 64 judges that the direction of change of the potential of the output signal line 60 is raising of the potential, the selection signal supplying section 64 selects, from among the n types of potentials that are being supplied as the reference potentials Vref to the n potential detecting/changing circuits 50, a potential that is less than or equal to the recognized target potential and that is closest to that target potential. The selection signal supplying section 64 supplies a selection signal, that turns the PMOS transistor 56 for selection on, to the gate of the PMOS transistor 56 for selection of the potential detecting/changing circuit 50 at which the selected potential is being supplied as the reference potential Vref to the gates of the NMOS transistor 52 and PMOS transistor 54 for detection.

Further, when the selection signal supplying section 64 judges that the direction of change of the potential of the output signal line 60 is lowering of the potential, the selection signal supplying section 64 selects, from among the n types of potentials that are being supplied as the reference potentials Vref to the n potential detecting/changing circuits 50, a potential that is greater than or equal to the recognized target potential and that is closest to that target potential. The selection signal supplying section 64 supplies a selection signal, that turns the NMOS transistor 58 for selection on, to the gate of the NMOS transistor 58 for selection of the potential detecting/changing circuit 50 at which the selected potential is being supplied as the reference potential Vref to the gates of the NMOS transistor 52 and PMOS transistor 54 for detection.

Note that, in the present first exemplary embodiment, the NMOS transistor 52 for detection is an example of the first switching portion relating to the present invention (more specifically, the first switching portion of the second and eleventh aspects) and an example of the NMOS transistor of the eighth aspect. The PMOS transistor 54 for detection is an example of the second switching portion relating to the present invention (more specifically, the second switching portion of the fourth and eleventh aspects) and an example of the PMOS transistor of the eighth aspect. The PMOS transistor 56 for selection is an example of the third switching portion of the third aspect. The NMOS transistor 58 for selection is an example of the fourth switching portion of the fifth aspect. The switching control section 44 is an example of the control section relating to the present invention (more specifically, the control sections of the second through fifth aspects). The decoder circuit 36 is an example of the potential switching portion of the first aspect, and the amplification circuit 48 is an example of the amplification circuit of the eleventh aspect. Further, the potential that is supplied to the gate of the NMOS transistor 52 for detection is an example of the first reference potential, and the potential that is supplied to the gate of the PMOS transistor 54 for detection is an example of the second reference potential.

Operation of the present exemplary embodiment is described next. As described previously, the decoder circuit 36 of the source driver 16 of the driving device 12 selects, from among plural types of gradation voltages supplied from the gradation voltage generating section 38, the gradation voltage that corresponds to the display data of one pixel that was inputted from the level shifter 32 that is the previous stage, and changes the voltage level (potential) of the output signal line 60 to the selected gradation voltage. The speed at which the decoder circuit 36 changes the potential of the output signal line 60 (the output speed of the decoder circuit 36) is lower than the output speeds of the other circuits of the source driver 16, and is a main cause of impeding improvement in the operating speed of the source driver 16. Therefore, the potential changing assisting circuit group 40 is provided at the source driver 16 of the driving device 12 relating to the present exemplary embodiment.

When the selection signal supplying section 64 of the potential detecting/changing circuits 50 provided at the potential changing assisting circuit group 40 judges that the direction of change of the potential of the output signal line 60 is raising of the potential, the selection signal supplying section 64 selects, from among the n types of potentials that are being supplied as the reference potentials Vref to the n potential detecting/changing circuits 50, a potential that is less than or equal to the recognized target potential and that is closest to that target potential. The selection signal supplying section 64 supplies a selection signal, that turns the PMOS transistor 56 for selection on, to the gate of the PMOS transistor 56 for selection of the potential detecting/changing circuit 50 at which the selected potential is being supplied as the reference potential Vref to the gates of the NMOS transistor 52 and PMOS transistor 54 for detection.

When the PMOS transistor 56 for selection, to whose gate the selection signal is supplied, turns on, the NMOS transistor 52 for detection that is connected to that PMOS transistor 56 for selection is on during the time until the potential of the output signal line 60 reaches the reference potential Vref that is being supplied to the gate. Therefore, during the time until the potential of the output signal line 60 reaches the reference potential Vref, the output signal line 60 is connected to the power source via the NMOS transistor 52 for detection and the PMOS transistor 56 for selection.

Figure 3B:
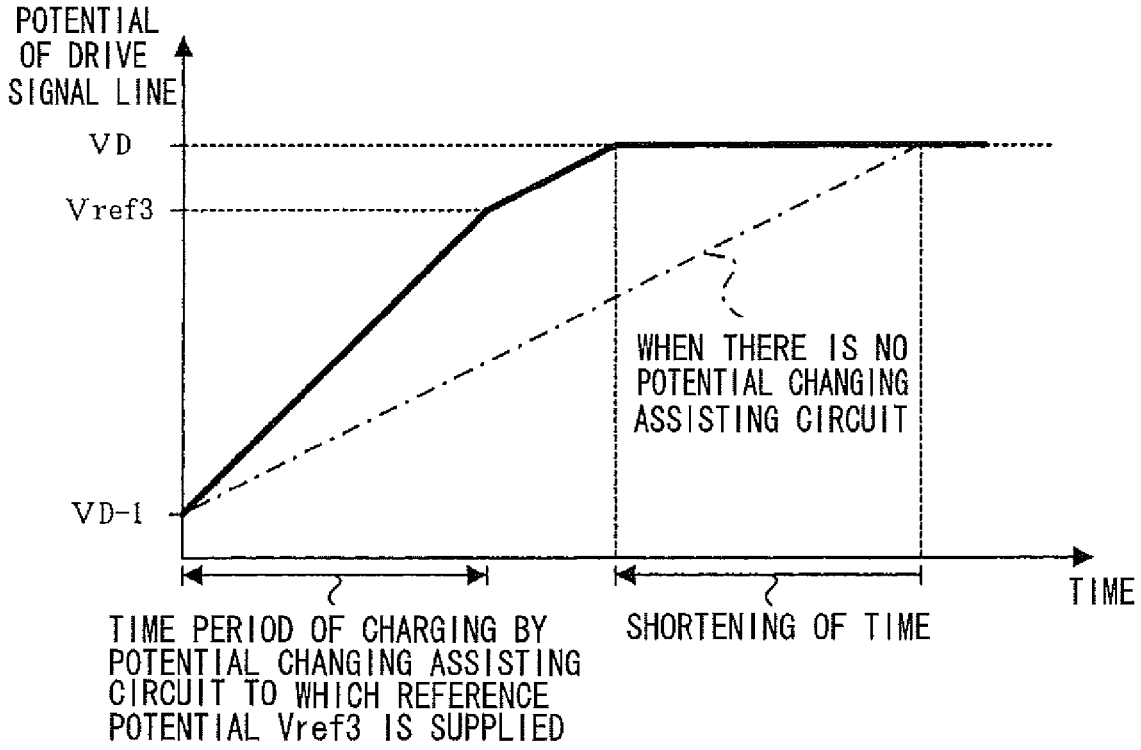
FIGS. 3B, 3C are graphs respectively showing examples of changes in potential of a drive signal line.

As an example, FIG. 3B illustrates the change in potential of the output signal line 60 when a target potential VD of the output signal line 60, that was recognized by the selection signal supplying section 64, is higher than target potential VD−1 of the previous cycle of the horizontal synchronizing signal and is higher than reference potential Vref3 (VD>VD−1, VD>Vref3). As is clear from FIG. 3B as well, because the output signal line 60 is connected to the power source during the time until the potential of the output signal line 60 reaches the reference potential Vref3, the potential of the output signal line 60 changes quickly in that time period, as is clear also by comparing the slope of the change in the potential of the output signal line 60 during that time period with the slope of the change in potential in a case in which the potential changing assisting circuit group 40 is not provided (the slope of the one-dot chain line shown in FIG. 3B).

When the potential of the output signal line 60 reaches the reference potential Vref3, the connection between the output signal line 60 and the power source is cancelled due to the NMOS transistor 52 for detection turning off, and the slope of the change in potential of the output signal line 60 also becomes smaller, similarly to the case in which the potential changing assisting circuit group 40 is not provided. However, as shown by the portion marked "shortening of time" in FIG. 3B, because the overall time required to change the output signal line 60 from the potential VD−1 to the potential VD is shortened, an improvement in the operating speed of the source driver 16 can be realized. Further, because the NMOS transistor 52 for detection turns off when the potential of the output signal line 60 reaches the reference potential Vref3, wasteful consumption of electric power can be suppressed as compared with a case in which the NMOS transistor 52 for detection is made to be on for a given time period that is set in advance, or the like.

Further, when the selection signal supplying section 64 of the potential detecting/changing circuits 50 judges that the direction of change of the potential of the output signal line 60 is lowering of the potential, the selection signal supplying section 64 selects, from among the n types of potentials that are being supplied as the reference potentials Vref to the n potential detecting/changing circuits 50, a potential that is greater than or equal to the recognized target potential and that is closest to that target potential. The selection signal supplying section 64 supplies a selection signal, that turns the NMOS transistor 58 for selection on, to the gate of the NMOS transistor 58 for selection of the potential detecting/changing circuit 50 at which the selected potential is being supplied as the reference potential Vref to the gates of the NMOS transistor 52 and PMOS transistor 54 for detection.

When the NMOS transistor 58 for selection, to whose gate the selection signal is supplied, turns on, the PMOS transistor 54 for detection that is connected to that NMOS transistor 58 for selection is on during the time until the potential of the output signal line 60 reaches the reference potential Vref that is being supplied to the gate. Therefore, during the time until the potential of the output signal line 60 reaches the reference potential Vref, the output signal line 60 is connected to the ground line via the PMOS transistor 54 for detection and the NMOS transistor 58 for selection.

Figure 3C:
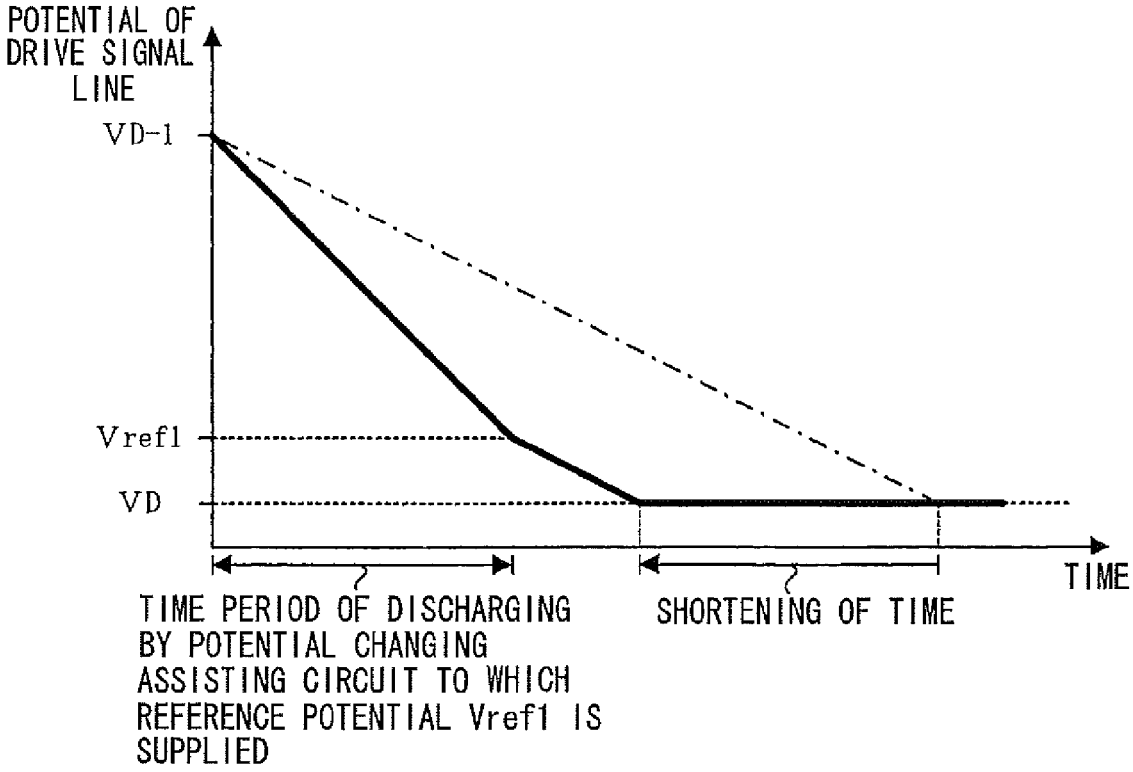

As an example, FIG. 3C illustrates the change in potential of the output signal line 60 when the target potential VD of the output signal line 60, that was recognized by the selection signal supplying section 64, is lower than target potential VD−1 of the previous cycle of the horizontal synchronizing signal and is lower than reference potential Vref1 (VD<VD−1, VD<Vref1). As is clear from FIG. 3C as well, because the output signal line 60 is connected to the ground line during the time until the potential of the output signal line 60 reaches the reference potential Vref1, the potential of the output signal line 60 changes quickly in that time period, as is clear also by comparing the slope of the change in the potential of the output signal line 60 during that time period with the slope of the change in potential in a case in which the potential changing assisting circuit group 40 is not provided (the slope of the one-dot chain line shown in FIG. 3C).

When the potential of the output signal line 60 reaches the reference potential Vref1, the connection between the output signal line 60 and the ground line is cancelled due to the PMOS transistor 54 for detection turning off, and the slope of the change in potential of the output signal line 60 also becomes smaller, similarly to the case in which the potential changing assisting circuit group 40 is not provided. However, as shown by the portion marked "shortening of time" in FIG. 3C, because the overall time required to change the output signal line 60 from the potential VD−1 to the potential VD is shortened, an improvement in the operating speed of the source driver 16 can be realized. Further, because the PMOS transistor 54 for detection turns off when the potential of the output signal line 60 reaches the reference potential Vref1, wasteful consumption of electric power can be suppressed as compared with a case in which the PMOS transistor 54 for detection is made to be on for a given time period that is set in advance, or the like.

Second Exemplary Embodiment

Figure 4:
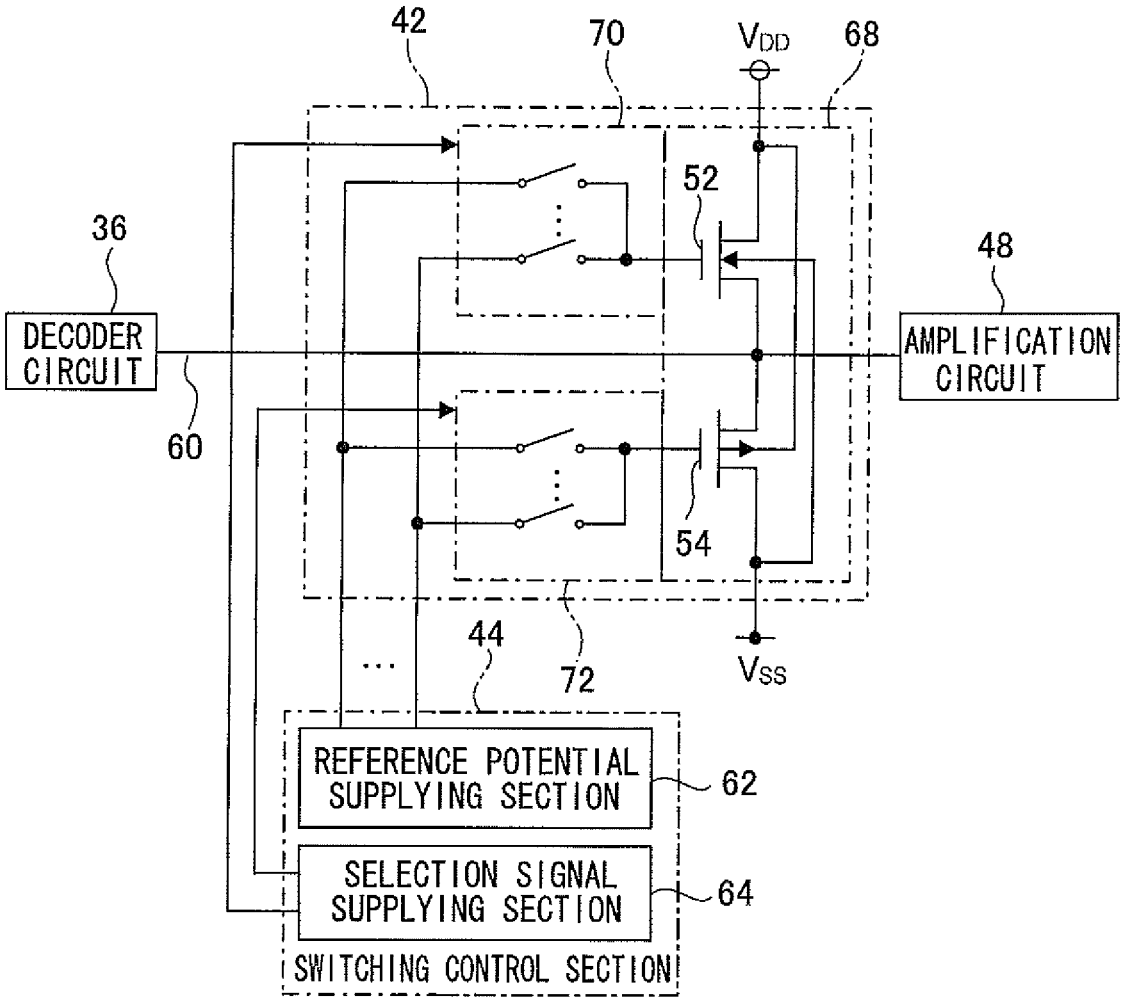
FIG. 4 is a circuit diagram showing the structure of the potential changing assisting circuit relating to a second exemplary embodiment.

A second exemplary embodiment of the present invention is described next. Note that portions that are the same as the first exemplary embodiment are denoted by the same reference numerals, and description thereof is omitted. The potential changing assisting circuit 42 and the switching control section 44 of the potential changing assisting circuit group 40 relating to the present second exemplary embodiment are shown in FIG. 4. As shown in FIG. 4, in the present second exemplary embodiment, a single potential detecting/changing circuit 68 is provided at the potential changing assisting circuit 42.

As compared with the potential detecting/changing circuit 50 described in the first exemplary embodiment, at the potential detecting/changing circuit 68, the PMOS transistor 56 and NMOS transistor 58 for selection are not provided. Further, at the NMOS transistor 52 for detection, the source is connected to the power source, and the gate is connected to a potential selection circuit 70. At the PMOS transistor 54 for detection, the source is connected to the ground line, and the gate is connected to a potential selection circuit 72.

From the reference potential supplying section 62 of the switching control section 44, n types of potentials (reference potentials Vref1 through Vrefn) are respectively supplied to the potential selection circuits 70, 72. The potential selection circuits 70, 72 have n switching elements that are turned on and off in accordance with a selection signal inputted from the selection signal supplying section 64 of the switching control section 44. In accordance with the selection signal inputted from the selection signal supplying section 64, any one of the potentials, among the n types of potentials that are supplied from the reference potential supplying section 62, is supplied as the reference potential Vref to the gate of the NMOS transistor 52 for detection or the gate of the PMOS transistor 54 for detection.

Note that, in the present second exemplary embodiment, the NMOS transistor 52 for detection is an example of the first switching portion relating to the present invention (more specifically, the first switching portion of the sixth aspect) and an example of the NMOS transistor of the eighth aspect. The PMOS transistor 54 for detection is an example of the second switching portion relating to the present invention (more specifically, the second switching portion of the seventh aspect) and an example of the PMOS transistor of the eighth aspect. The switching control section 44 is an example of the control section relating to the present invention (more specifically, the control section of the sixth and seventh aspects). The decoder circuit 36 is an example of the potential switching portion of the first aspect, and the amplification circuit 48 is an example of the amplification circuit of the eleventh aspect. Further, the potential that is supplied to the gate of the NMOS transistor 52 for detection is an example of the first reference potential, and more specifically, the "any one potential among the n types of potentials" in the sixth aspect. The potential that is supplied to the gate of the PMOS transistor 54 for detection is an example of the second reference potential, and more specifically, the "any one potential among the n types of potentials" in the seventh aspect.

Operation of the present second exemplary embodiment is described next. When the selection signal supplying section 64 of the potential detecting/changing circuit 68 judges that the direction of change of the potential of the output signal line 60 is raising of the potential, the selection signal supplying section 64 selects, from among the n types of potentials that the reference potential supplying section 62 is supplying to the potential selection circuits 70, 72, a potential that is less than or equal to the recognized target potential and that is closest to that target potential, and supplies, to the potential selection circuit 70, a selection signal for causing the selected potential to be outputted from the potential selection circuit 70. Due thereto, the potential that was selected in the above description is supplied as the reference potential Vref to the gate of the NMOS transistor 52 for detection. Due to the NMOS transistor 52 for detection being on during the time until the potential of the output signal line 60 reaches the reference potential Vref that is being supplied to the gate, the output signal line 60 is connected to the power source via the NMOS transistor 52 for detection, during the time until the potential of the output signal line 60 reaches the reference potential Vref.

Accordingly, in the same way as in the first exemplary embodiment, the time required until the output signal line 60 changes from the potential VD−1 to the higher potential VD is shortened (refer to FIG. 3B as well), and an improvement in the operating speed of the source driver 16 can be realized. Further, because the NMOS transistor 52 for detection turns off when the potential of the output signal line 60 reaches the reference potential Vref that is supplied to the gate, wasteful consumption of electric power can be suppressed as compared with a case in which the NMOS transistor 52 for detection is made to be on for a given time period that is set in advance, or the like.

Further, when the selection signal supplying section 64 of the potential detecting/changing circuit 68 judges that the direction of change of the potential of the output signal line 60 is lowering of the potential, the selection signal supplying section 64 selects, from among the n types of potentials that the reference potential supplying section 62 is supplying to the potential selection circuits 70, 72, a potential that is greater than or equal to the recognized target potential and that is closest to that target potential, and supplies, to the potential selection circuit 72, a selection signal for causing the selected potential to be outputted from the potential selection circuit 72. Due thereto, the potential that was selected in the above description is supplied as the reference potential Vref to the gate of the PMOS transistor 54 for detection. Due to the PMOS transistor 54 for detection being on during the time until the potential of the output signal line 60 reaches the reference potential Vref that is being supplied to the gate, the output signal line 60 is connected to the power source via the PMOS transistor 54 for detection, during the time until the potential of the output signal line 60 reaches the reference potential Vref.

Accordingly, in the same way as in the first exemplary embodiment, the time required until the output signal line 60 changes from the potential VD−1 to the lower potential VD also is shortened (refer to FIG. 3C as well), and an improvement in the operating speed of the source driver 16 can be realized. Further, because the PMOS transistor 54 for detection turns off when the potential of the output signal line 60 reaches the reference potential Vref that is supplied to the gate, wasteful consumption of electric power can be suppressed as compared with a case in which the PMOS transistor 54 for detection is made to be on for a given time period that is set in advance, or the like.

Third Exemplary Embodiment

Figure 5:
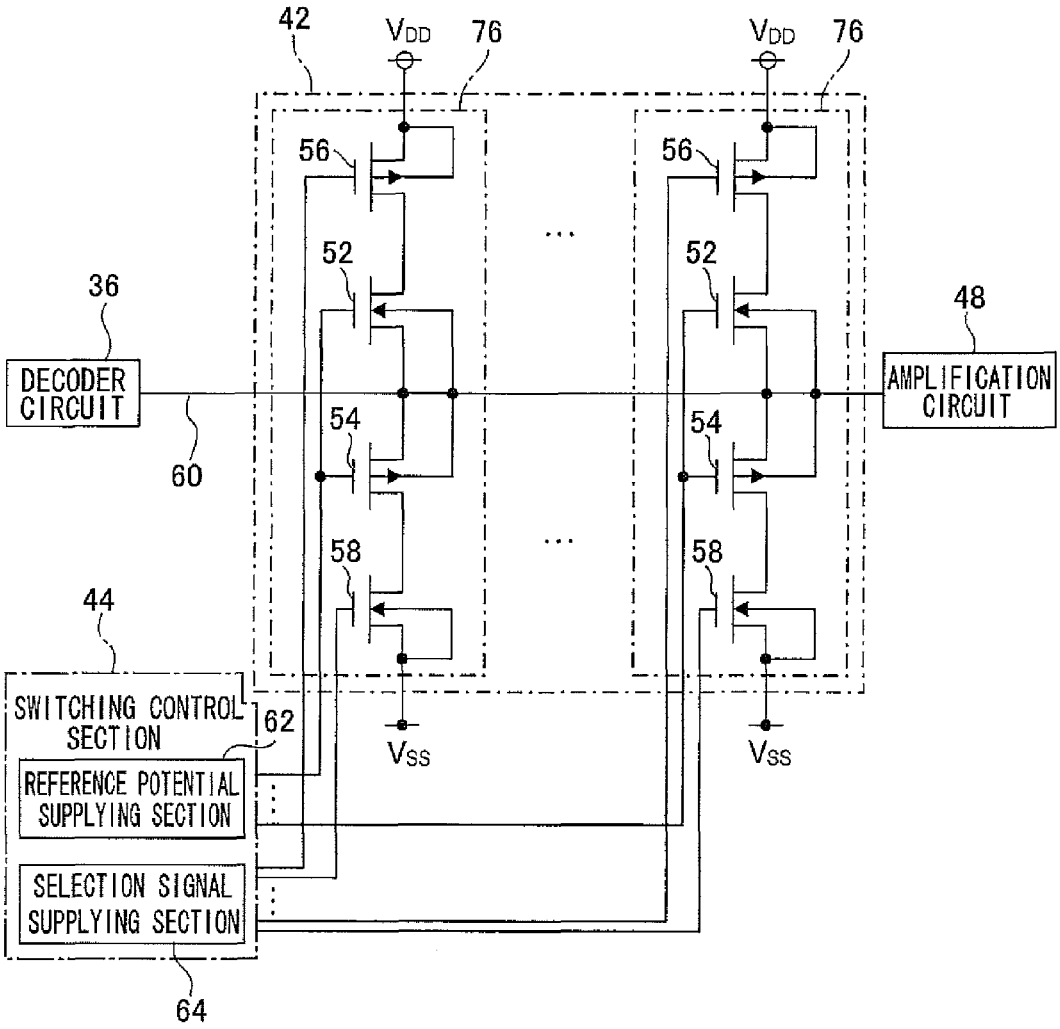
FIG. 5 is a circuit diagram showing the structure of the potential changing assisting circuit relating to a third exemplary embodiment.
Figure 6B:
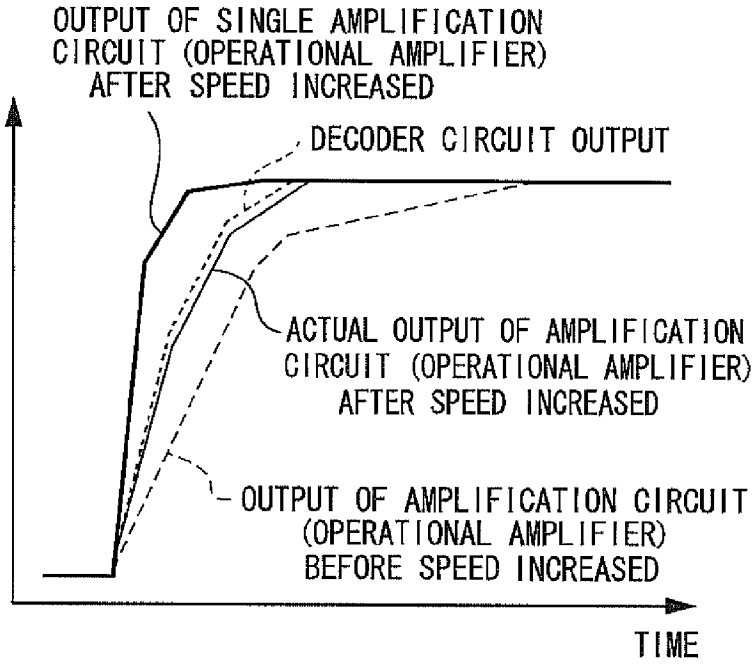
FIG.6B PRIOR ART
FIGS. 6A, 6B are graphs for explaining causes of impeding improvement in operating speed at (a source driver) of a driving device of a display device.
Figure 6A:
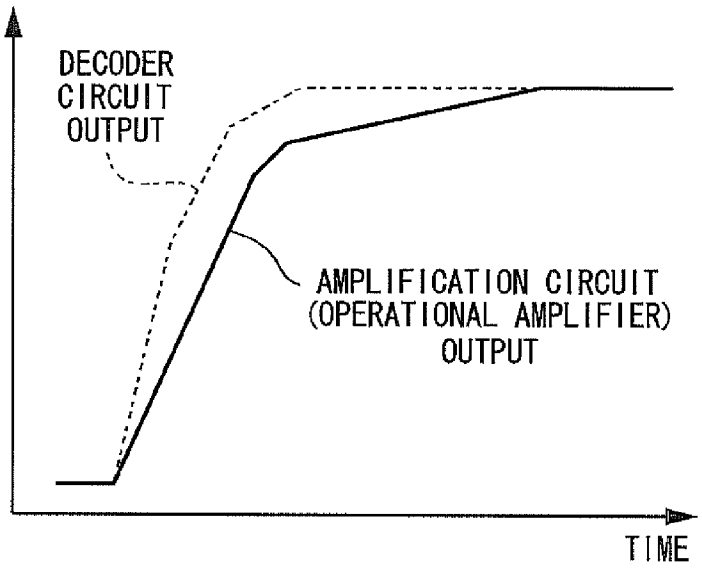
FIG.6A PRIOR ART

A third exemplary embodiment of the present invention is described next. Note that portions that are the same as the first exemplary embodiment are denoted by the same reference numerals, and description thereof is omitted. The potential changing assisting circuit 42 and the switching control section 44 of the potential changing assisting circuit group 40 relating to the present third exemplary embodiment are shown in FIG. 5. As shown in FIG. 5, potential detecting/changing circuits 76 relating to the present third exemplary embodiment differ from the potential detecting/changing circuits 50 described in the first exemplary embodiment only with regard to the point that the back gates of the NMOS transistor 52 and PMOS transistor 54 for detection are connected to the output signal line 60.

Note that, in the present third exemplary embodiment, the NMOS transistor 52 for detection is an example of the NMOS transistor in claim 9. The PMOS transistor 54 for detection is an example of the PMOS transistor in claim 9.

In the case of the potential detecting/changing circuits 50 described in the first exemplary embodiment, when the back gate of the NMOS transistor 52 for detection is connected to the ground line, and the back gate of the PMOS transistor 54 for detection is connected to the power source, a potential difference arises (back bias is applied) between the output signal line 60 and the back gates of the NMOS transistor 52 and PMOS transistor 54 for detection. Therefore, the transistor that is on among the NMOS transistor 52 and PMOS transistor 54 for detection turns off at a time that is slightly earlier than the time when the potential of the output signal line 60 reaches the reference voltage Vref supplied to the gate (i.e., turns off at the time when the difference between the potential of the output signal line 60 and the reference potential Vref decreases to a threshold voltage Vt of the transistor).

In contrast, in the case of the potential detecting/changing circuits 76 relating to the present third exemplary embodiment, when the back gates of the NMOS transistor 52 and NMOS transistor 54 for detection are connected to the output signal line 60, back bias is not applied to the NMOS transistor 52 and the PMOS transistor 54 for detection. Therefore, the transistor that is on among the NMOS transistor 52 and PMOS transistor 54 for detection is on until the time when the potential of the output signal line 60 reaches the reference potential Vref supplied to the gate. Due thereto, the time period over which the NMOS transistor 52 and PMOS transistor 54 for detection are on is long, and therefore, the time required until the output signal line 60 changes from the potential VD−1 to the potential VD is further shortened, and the operating speed of the source driver 16 can be improved more.

Note that the third exemplary embodiment describes a structure in which, in the structure described in the first exemplary embodiment, the back gates of the NMOS transistor 52 and PMOS transistor 54 for detection are connected to the output signal line 60. However, the present invention is not limited to the same, and the back gates of the NMOS transistor 52 and PMOS transistor 54 for detection may be connected to the output signal line 60 in the structure described in the second exemplary embodiment.

Further, the above describes an aspect in which the reference potential Vref, that is the target potential at the time of turning the NMOS transistor 52 and PMOS transistor 54 for detection on and changing the potential of the output signal line 60, is supplied to the gates of the NMOS transistor 52 and PMOS transistor 54 for detection. However, the present invention is not limited to the same. A potential that is higher by a predetermined value (e.g., the threshold voltage Vt of the transistor) than the reference potential may be supplied to the gates of the NMOS transistor 52 and PMOS transistor 54 for detection. In this case as well, the time period over which the NMOS transistor 52 and PMOS transistor 54 for detection are on can be made to be longer, in the same way as in the case in which the back gates of the NMOS transistor 52 and PMOS transistor 54 for detection are connected to the output signal line 60. Note that the above-described aspect is an example of the invention of claim 10.

Further, the potential changing assisting circuit 42 is not limited to the structures shown in FIGS. 2, 4, 5, and the structures at the side that connects the output signal line 60 to the power source and the side that connects the output signal line 60 to the ground line may be made to differ. Namely, for example, the side that connects the output signal line 60 to the power source may be a structure that is provided with the plural NMOS transistors 52 for detection to whose gates respectively different potentials are supplied, as shown in FIGS. 2 and 5, and, on the other hand, the side that connects the output signal line 60 to the ground line may be a structure that is provided with the single PMOS transistor 54 for detection at which the potential that is supplied to the gate is switched from among plural potentials by a potential selection circuit as shown in FIG. 4. Or, the structure of the side that connects the output signal line 60 to the power source and the structure of the side that connects the output signal line 60 to the ground line may be made to be structures that are vice-versa to those described above.

Moreover, the above describes an aspect in which the first switching portion is structured by the NMOS transistor 52 for detection and the second switching portion is structured by the PMOS transistor 54 for detection. However, the present invention is not limited to the same, and can be structured to use switching elements other than MOS transistors.

What is claimed is:

1. A driving device of a display device, comprising:

a first switching portion that is provided between a potential switching portion, that switches a potential of a drive signal line to a target potential that corresponds to display data, and a display device, to which the potential of the drive signal line is supplied as voltage, the first switching portion connecting the drive signal line to a power source during a time until the potential of the drive signal line reaches a first reference potential that is higher than a potential of the drive signal line during a previous cycle;

a second switching portion that is provided between the potential switching portion and the display device, and that connects the drive signal line to a ground line during a time until the potential of the drive signal line reaches a second reference potential that is lower than a potential of the drive signal line during the previous cycle; and a control section that, when the potential of the drive signal line during the previous cycle is lower than the target potential, operates the first switching portion by using, as the first reference potential, a potential that is less than or equal to the target potential and that is closest to the target potential, among predetermined n types (n≥1) of potentials, and, when the potential of the drive signal line during the previous cycle is higher than the target potential, operates the second switching portion by using, as the second reference potential, a potential that is greater than or equal to the target potential and that is closest to the target potential, among the n types of potentials.

2. The driving device of a display device of claim 1, wherein a plurality of the first switching portions are provided, and potentials, that are different from one another among the n types of potentials, are supplied as the first reference potential to the individual first switching portions, and when the potential of the drive signal line during the previous cycle is lower than the target potential, the control section operates, among the plurality of first switching portions, the first switching portion to which a potential, that is less than or equal to the target potential and that is closest to the target potential, is supplied as the first reference potential.

3. The driving device of a display device of claim 2, further comprising third switching portions respectively provided between the individual first switching portions and the power source, wherein by turning on, of the plurality of third switching portions, the third switching portion that is provided between the power source and a specific first switching portion to be operated, the control section operates the specific first switching portion.

4. The driving device of a display device of claim 1, wherein a plurality of the second switching portions are provided, and potentials, that are different from one another among the n types of potentials, are supplied as the second reference potential to the individual second switching portions, and when the potential of the drive signal line during the previous cycle is higher than the target potential, the control section operates, among the plurality of second switching portions, the second switching portion to which a potential, that is greater than or equal to the target potential and that is closest to the target potential, is supplied as the second reference potential.

5. The driving device of a display device of claim 4, further comprising fourth switching portions respectively provided between the individual second switching portions and the ground line, wherein by turning on, of the plurality of fourth switching portions, the fourth switching portion that is provided between the ground line and a specific second switching portion to be operated, the control section operates the specific second switching portion.

6. The driving device of a display device of claim 1, wherein any one potential among the n types of potentials is selectively supplied to the first switching portion as the first reference potential, and when the potential of the drive signal line during the previous cycle is lower than the target potential, due to the control section causing a potential, that is less than or equal to the target potential and that is closest to the target potential among the n types of potentials, to be supplied to the first switching portion as the first reference potential, the control section operates the first switching portion by using the potential, that is less than or equal to the target potential and that is closest to the target potential, as the first reference potential.

7. The driving device of a display device of claim 1, wherein any one potential among the n types of potentials is selectively supplied to the second switching portion as the second reference potential, and when the potential of the drive signal line during the previous cycle is higher than the target potential, due to the control section causing a potential, that is greater than or equal to the target potential and that is closest to the target potential among the n types of potentials, to be supplied to the second switching portion as the second reference potential, the control section operates the second switching portion by using the potential, that is greater than or equal to the target potential and that is closest to the target potential, as the second reference potential.

8. The driving device of a display device of claim 1, wherein the first switching portion comprises an NMOS transistor whose back gate is connected to the ground line, and the second switching portion comprises a PMOS transistor whose back gate is connected to the power source.

9. The driving device of a display device of claim 1, wherein the first switching portion comprises an NMOS transistor whose back gate is connected to the drive signal line, and the second switching portion comprises a PMOS transistor whose back gate is connected to the drive signal line.

10. The driving device of a display device of claim 1, further comprising an amplification circuit that is provided between the potential switching portion and the display device, wherein the first switching portion and the second switching portion connect a region of the drive signal line, which region is between the potential switching portion and the amplification circuit, to the power source or the ground line.

* * * * *